US011553743B2

(12) United States Patent
Rubio

(10) Patent No.: US 11,553,743 B2
(45) Date of Patent: Jan. 17, 2023

(54) PERSONAL SHIELD

(71) Applicant: Art Rubio, Laguna Niguel, CA (US)

(72) Inventor: Art Rubio, Laguna Niguel, CA (US)

( * ) Notice: Subject to any disclaimer, the term of this patent is extended or adjusted under 35 U.S.C. 154(b) by 169 days.

(21) Appl. No.: 16/926,667

(22) Filed: Jul. 11, 2020

(65) Prior Publication Data

US 2022/0007762 A1 Jan. 13, 2022

(51) Int. Cl.

| | |
|---|---|
| ***A41D 13/11*** | (2006.01) |
| *A42B 3/20* | (2006.01) |
| *A42B 3/22* | (2006.01) |
| *A42B 3/18* | (2006.01) |

(52) U.S. Cl.

CPC ..... *A41D 13/1184* (2013.01); *A41D 13/1192* (2013.01); *A41D 13/1107* (2013.01); *A42B 3/18* (2013.01); *A42B 3/185* (2013.01); *A42B 3/20* (2013.01); *A42B 3/205* (2013.01); *A42B 3/22* (2013.01)

(58) Field of Classification Search

CPC ..... A41D 13/1184; A41D 13/1192; A41D 13/1107; A42B 3/18; A42B 3/185; A42B 3/20; A42B 3/205; A42B 3/22

USPC ..... 2/424

See application file for complete search history.

(56) References Cited

U.S. PATENT DOCUMENTS 1,166,977 A * 1/1916 Favary ..... A61F 9/06 2/11
3,772,707 A * 11/1973 Alosi ..... A45D 44/12 2/9
4,396,027 A * 8/1983 Loewenstine ..... A45D 44/12 132/212
4,919,258 A * 4/1990 Perretta ..... A45C 11/04 206/5
5,241,154 A * 8/1993 Estrate ..... B23K 9/32 219/136
5,641,934 A * 6/1997 Follett ..... F41H 5/0407 89/36.05
5,822,801 A * 10/1998 Varney ..... A45D 44/12 132/319
7,000,251 B2 * 2/2006 DeYoung ..... A61F 9/06 2/9
7,007,306 B2 * 3/2006 Howard ..... A42B 3/14 2/9
9,474,651 B2 * 10/2016 Terranova ..... A61F 9/061
9,839,798 B2 * 12/2017 Franke ..... A62B 18/082
10,231,495 B2 * 3/2019 Nabai ..... A61B 90/30
10,575,514 B1 * 3/2020 Sasaki ..... G02C 7/10
10,791,784 B2 * 10/2020 Kang ..... A42B 1/08
10,806,235 B1 * 10/2020 Bernstein ..... A41D 13/1184
10,945,470 B1 * 3/2021 Maroofian ..... A41D 13/1107
11,083,916 B2 * 8/2021 Duffy ..... A41D 13/1115
11,147,323 B1 * 10/2021 Wilson ..... A42B 1/0182
(Continued)

*Primary Examiner* — Khaled Annis
*Assistant Examiner* — Dakota Marin
(74) *Attorney, Agent, or Firm* — Mark S Hubert

(57) ABSTRACT

A completely planar, translucent, hand held protective shield to be held in front of one's face to eliminate saliva and antigen transmission from person to person when in close contact. when social distancing. The handle is copper clad to kill antigens including viruses. The material of construction is plexiglass so it is dishwasher safe. Anti-glare, anti-fogging and anti reflective surface treatments may be applied to one or both of the planar faces of the body. Optional visual alignment marks may also be incorporated on the face/s of the shield.

6 Claims, 5 Drawing Sheets

(56) References Cited

U.S. PATENT DOCUMENTS

| | | | | |
|---|---|---|---|---|
| 2002/0121033 | A1* | 9/2002 | Hildyard | G09F 21/02 40/586 |
| 2007/0174952 | A1* | 8/2007 | Jacob | B63C 11/16 2/426 |
| 2008/0034458 | A1* | 2/2008 | Ku | A41D 13/1184 2/9 |
| 2009/0078264 | A1* | 3/2009 | Martin | A62B 23/025 128/206.17 |
| 2015/0209174 | A1* | 7/2015 | Abreu | A61F 7/02 607/104 |
| 2017/0238641 | A1* | 8/2017 | Chapman | A42B 7/00 |
| 2022/0030975 | A1* | 2/2022 | Schultz | A41D 13/11 |

* cited by examiner

PERSONAL SHIELD

FIELD

The present disclosure relates, in general, to a portable, personal protection device to retard the spread of COVID-19 and other viruses between people in close proximity.

BACKGROUND

The spread of germs, viruses and other infectious antigens has been shown to occur through several routes, the most prevalent and easiest to protect against, is person-to-person, close proximity airborne transmission. This can be minimized through the use of proper masks, or with a barrier between the people in close proximity.

Barriers allow people to speak more clearly, eat, drink and not worry about transmission through expelled and exhaled saliva droplets. It is a much friendlier and comfortable way to protect oneself. These barriers can be seen in curved face shields mountable to hats or with their own spaced head mounts. Unfortunately, these type of shields reflect speech back to the wearer's own ears, fog up momentarily impairing vision and their weight over extended periods of time, can lead to neck discomfort.

Another type of barrier is the translucent Plexiglas sheets erected in front of work stations for those experiencing a constant parade of people by them, such as cashiers at a grocery store. The problem these pose, is that they are fixed and offer no protection to the cashier when they touch money or goods or have to move from behind the barrier.

Lastly, it has been proven that contact transmission of antigens for infectious diseases, viruses and infections occurs most commonly by people touching their faces especially noses, eyes and lips. Neither masks or shields can help protect against this type of transmission.

Henceforth, a personal barrier that did not impair vision, hurt the neck, direct sound back to the user, allow the user to eat and drink and talk clearly, as well as kill any antigen that the user picked up on their hands, would fulfill a long felt need in the respiratory disease prevention industry. This new invention utilizes and combines known and new technologies in a unique and novel configuration to overcome the aforementioned problems and accomplish this.

BRIEF SUMMARY

In accordance with various embodiments, a personal protective shield is provided.

In one aspect, a personal protective shield that can be made at an economical cost and mass produced quickly and simply.

In another aspect, a personal protective shield that also prevents the transmission of antigens to the user's hands to minimize contact transmission is provided.

In yet another aspect, a personal protective shield that can easily be discarded momentarily for mechanical operations or when the distance between people had increased to a safe distance is provided.

In yet another aspect, a personal protective device that does not hamper vision, speech, breathing, eating or drinking, is provided.

Lastly, a personal protective shield that may be disinfected in a common dishwasher is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

Figure 2:
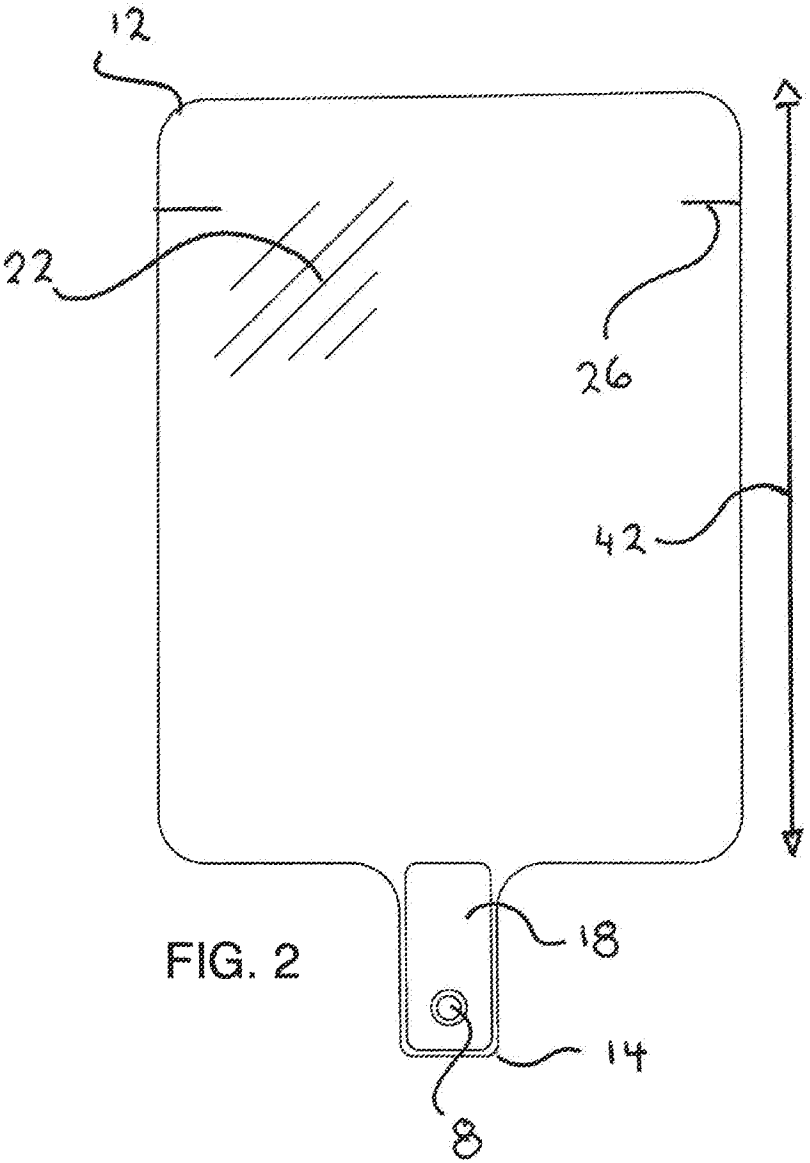
FIG. 2 is a rear view of the protective shield.

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details. The described examples are provided for illustrative purposes and are not intended to limit the scope of the invention.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features or components, but do not preclude the presence or addition of one or more other features or components, and/or groups thereof.

As used herein, the term "plexiglass" refers to any of a plethora of translucent polymeric materials such as Ethylene Vinyl Acetate, Polyethylene Terephthalate (glycol modified and heat stabilized), M-ABS, Polycarbonate, Poly Cyclohexylenedimethylene Terephthalate (glycol modified), Polyethersulfone, Polyethylene Terephthalate (glycol-modified), Polymethyl Methacrylate, Polypropylene, Polyphenylsulfone, PS, Polysulfone, Styrene Acrylonitrile, Styrene Butadiene Copolymer, Styrene Methyl Methacrylate, and Polypropylene based elastomers.

The preferred embodiment of the present invention relates to a novel design for a portable, personal protective shield that is lightweight, easily cleaned, inexpensive, dishwasher safe, resistant to fogging, anti-glare and has an antiviral copper clad handle. In an alternative embodiment, (not illustrated herein) the handle is configured into a hollow right cylinder with a cap that houses a small cylindrical manual pump mister that sprays a surface disinfectant solution.

Figure 8:
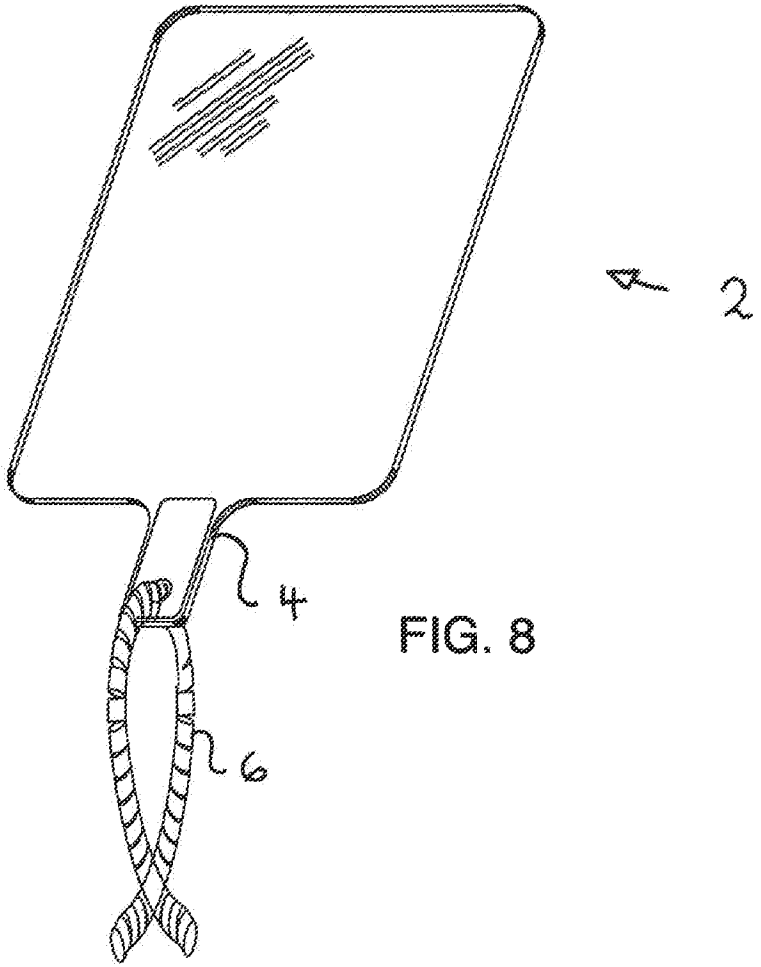
FIG. 8 is a perspective view of the protective shield.

As can be seen by FIG. 8 the personal protective shield 2 (hereinafter "PPS") is a translucent, planar hand held, one piece barrier similar in shape to a paddle, except for the planar handle 4. The handle has a retention loop 6 extending through the handle orifice 8 (FIGS. 1 and 2) that is located at the distal end of the handle 4 of the PPS. This is intended both as a retention strap to be worn around the user's wrist as well as a loop to hang the PPS 2 in when not in use. The PPS's main body and handle are formed from a single piece of plexiglass having a ⅛ inch thickness as indicated by dimensional arrow 40 of FIG. 3.

Figure 1:
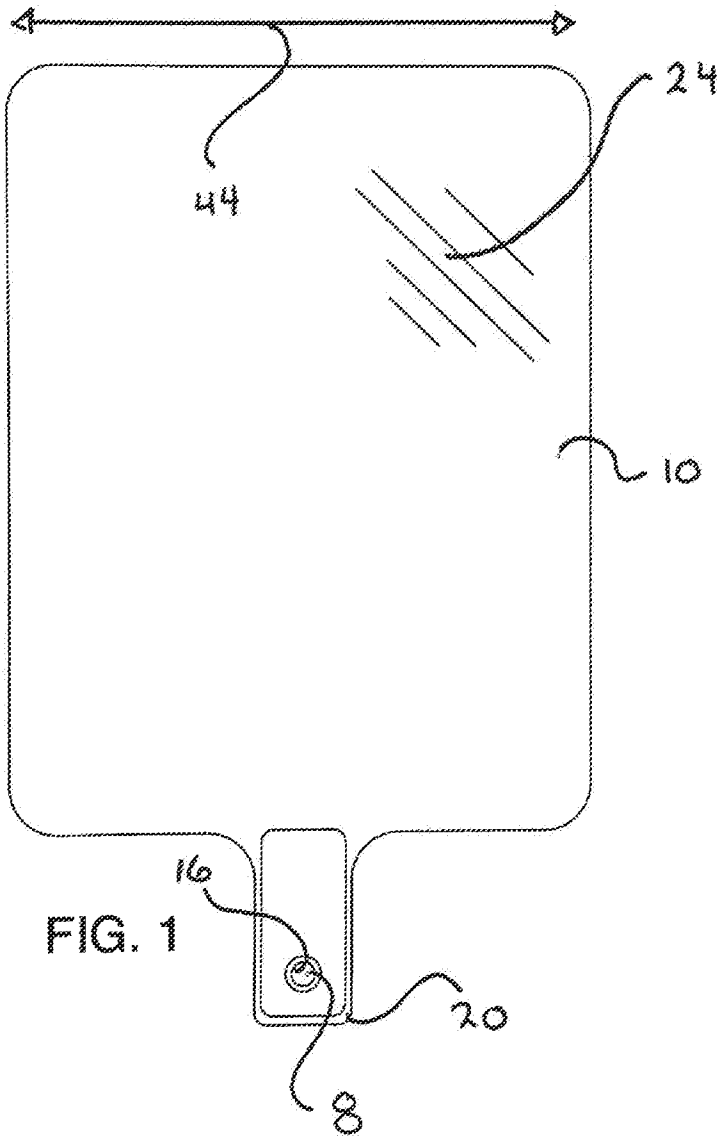
FIG. 1 is a front view of the protective shield.
Figure 3:
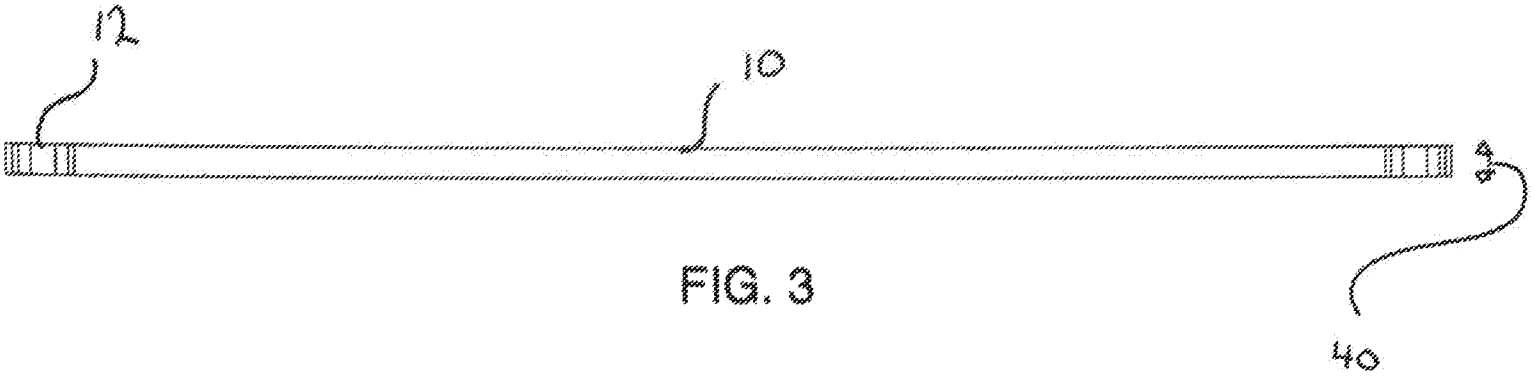
FIG. 3 is a top view of the protective shield.
Figure 4:
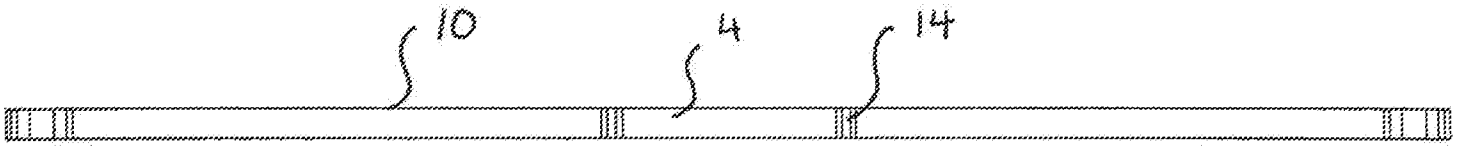
FIG. 4 is a bottom view of the protective shield.
Figure 5:
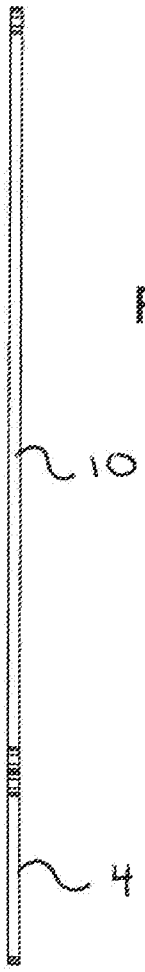
FIG. 5 is a left side view of the protective shield.
Figure 6:
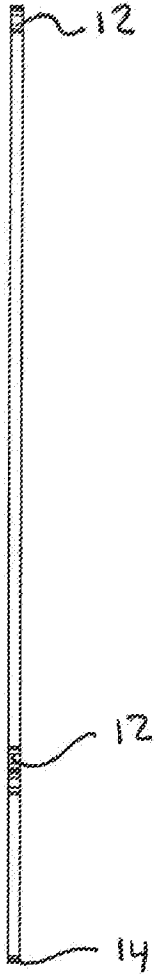
FIG. 6 is a right side view of the protective shield.

Looking at FIGS. 1 and 2, it can be seen that the main body 10 of the PPS is a generally rectangular plate with rounded corners 12. In the preferred embodiment the dimensions of the main body is eight inches high (as indicated by dimensional arrow 42 of FIG. 2) and six inches wide (as indicated by dimensional arrow 44 of FIG. 1) and the corners rounded with a 0.50 inch radius including the radius at the intersection of the main body 10 and the proximal end of the handle 4. (Optionally the edges of the entire PPS may also be radiused to prevent cuts.) Studies have shown that when held at a distance of approximately 14 inches from the human face, this size shield will stop virtually all droplets of saliva ejected in a standard cone dispersion model from an adult human mouth with an opening diameter in the range from 32 mm to 77 mm. (The average human male can open their mouth 50-60 mm, and women 45-55 mm.) The planar faces of the main body are parallel.

The PPS material is of a clear plexiglass with the preferred embodiment using an ⅛ inch thick Poly Cyclohexylenedimethylene Terephthalate ("acrylic plexiglass"). The linear axis of the handle resides colinear with the linear axis of the main body of the PPS. That is to say the linear centerline of the main body 10 and the linear centerline of the handle 4 are colinear. The preferred method of fabrication is by laser or water jet cutting of the PPS's profile from ⅛ inch thick sheets of plexiglass is a cost and material efficient layout. Alternatively, since the plexiglass is so thin, the pattern could also be routed out by high speed carbide rotary cutter bits.

Figure 7:
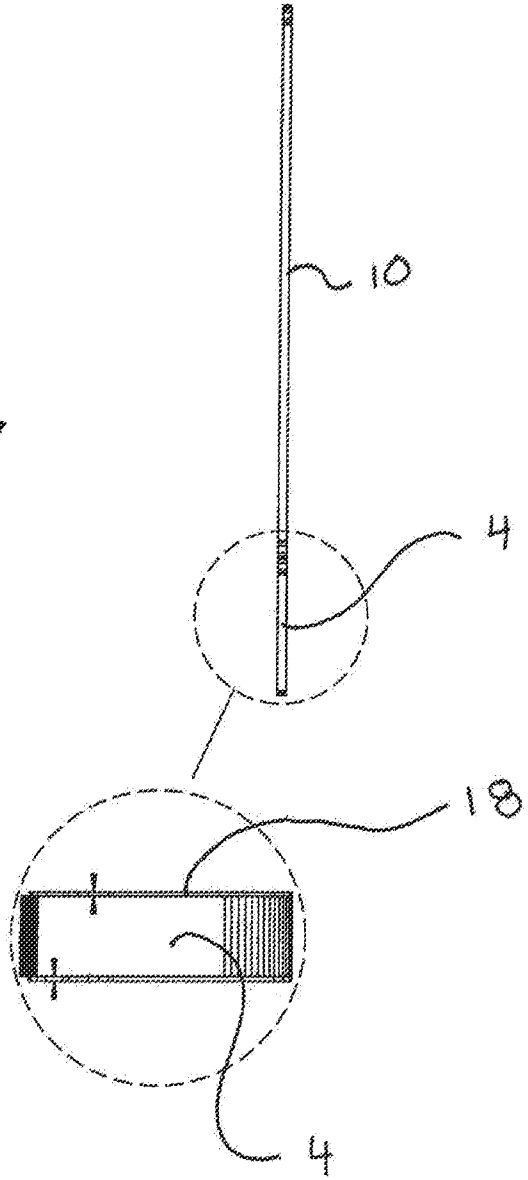
FIG. 7 is an enlarged view of the copper foil handle cover of the protective shield.

The handle 4 is two inches high and one inch wide with distal corner radiuses 14 of 0.13 inches. (See FIGS. 3-6) There is a handle orifice 8 at the distal end of the handle 4 that optionally has radiused edges 16. Both planar faces of the handle 4 are parallel and are clad with copper foil 18. (Illustrated is cross sectional profile in FIG. 7) These copper foil strips 18 do not extend to the edges of the handle 4 or onto the main body 10 of the PPS 2. Rather, they stop short of any edge of the handle 4 (including the edge of the handle orifice 8) so as to leave a perimeter of the plexiglass 20 visible for between 1/64 and ⅛ of an inch around the copper foil 18. This prevents any edge of the copper foil 18 from getting caught and being pulled back and curled off of the PPS 2. It also allows for a margin of error in the placement of the copper foil 18 onto the handle 4 during assembly such that the copper foil 18 never overhangs any edge of the handle 4. The copper foil 18 has antiviral and antibacterial contact properties to help the user's hands say uncontaminated from antigens. Although copper foil strips 18 are the preferred embodiment coating for the handles to keep the weight of the PPS down, thin copper plates could be glued or riveted onto the faces of the handle as well, however there is a direct relation between the weight of the PPS and the amount of tie the user will utilize it.

There are optional anti-glare surface treatments 24 (FIG. 1) for the front face and rear face of the PPS to prevent the shining of a light reflection to nearby people. There is also an optional anti-scratching surface treatment as well as an optional translucent color film that can be applied to either or both of the planar faces of the main body 10 of the PPS 2. Lastly there is an anti-fogging coating 22 (FIG. 2) that can be applied to the user's side of the PPS although, at the 14 to 20 inch recommended distance from the face there should not be any visible fogging unless the PPS is being used constantly in extremely cold temperatures where the dew point constantly is high enough to cause condensation of the user's breath on the face of the PPS 2.

The plexiglass material used for the PPS is is selected to resist scratching and to be dishwasher safe. Optional visual horizontal alignment marks 26 (FIG. 2) may be drawn on the faces of the PPS such that the user can judge the height of the PPS in relation to their own mouth and to act as a reminder to properly position it vertically.

In use, the PPS 2 is intended to be held by the copper clad handle 4 by a bare hand with the retention strap 6 loosely around their wrist. It is to be held by a comfortable half bent elbow configuration so that the back face of the PPS is about 14-18 inches from the user's mouth. The PPS 2 is picked up when not eating or drinking and when the nearest person is essentially too close for the comfort of the user, preferably closer than Center for Disease Control's recommended six feet. The body 10 of the PPS 2 is held so that its linear axis is coplanar with the linear axis of the user's head (not tilted). The user can lower or set down the PPS when its protection is not necessary. The contact with the copper cladding 18 on the handle 4 will aid in killing any antigens that the user may have picked up on their hands by picking up a menu, pulling in their chair, touching table cloths, plates utensils, a bar and the like. This will minimize contact transmission from the hands to the face in the event of inadvertent touching. When not in use, the PPS 2 can be hung or put into a dishwasher for cleaning. Additionally, spraying the sides and front and rear faces of the PPS with a disinfection solution such as 70 percent or greater alcohol will prepare it for the next use.

While certain features and aspects have been described with respect to exemplary embodiments, one skilled in the art will recognize that numerous modifications are possible. Consequently, in view of the wide variety of permutations and options to the embodiment described herein, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

Having thus described the invention, what is claimed as new and desired to be secured by Letters Patent is as follows:

1. A personal protective shield to mitigate the transmission of antigens person to person, comprising:

a planar generally rectangular body having a first pair of parallel planar faces, said body with rounded corners;

an integrated handle extending from and coplanar with said rectangular body, wherein said handle having a second pair of parallel planar faces, said body and said handle fabricated from a single piece of plexiglass;

a handle orifice formed through said handle at a distal end of said handle;

a retention loop passing through said handle orifice; and at least two copper foil strips affixed on a planar face of said handle, each of said at least two copper foil strips conformed with an identical geometric configuration as said handle but scaled to a smaller dimension such that there is a perimeter of said second planar faces of said handle visibly exposed about a perimeter of said at least two copper foil strips.

2. The personal protective shield of claim 1 further comprising an anti-glare surface coating applied to at least one of said first pair of parallel planar faces.

3. The personal protective shield of claim 1 further comprising an anti-scratch surface coating applied to at least one of said first pair of parallel planar faces.

4. The personal protective shield of claim 1 further comprising an anti-fogging surface coating applied to at least one of said first pair of parallel planar faces.

5. The personal protective shield of claim 1 further comprising at least one of a visual alignment mark applied to at least one of said first pair of parallel planar faces.

6. A personal protective shield to mitigate the transmission of antigens person to person, consisting essential of:

a planar generally rectangular body with a thickness of approximately one-eight of an inch, having a first pair of parallel planar faces, said body with rounded corners, said body having a height of approximately eight inches and a width of approximately 6 inches;

an integrated handle extending from and coplanar with said rectangular body, said handle having a height of approximately two inches and a width of approximately one inch, wherein said handle having a second pair of parallel planar faces, said body and said handle fabricated from a single piece of plexiglass;

at least two copper foil strips affixed on a planar face of said handle, each of said at least two copper foil strips conformed with an identical geometric configuration as said handle but scaled to a smaller dimension such that there is a perimeter of said second planar faces of said handle visibly exposed about a perimeter of said at least two copper foil strips.

* * * * *